United States Patent [19]

Tamaru

[11] 4,182,111

[45] Jan. 8, 1980

[54] ELECTRONIC TIMEPIECE

[75] Inventor: Munetaka Tamaru, Tokyo, Japan

[73] Assignee: Citizen Watch Co., Ltd., Tokyo, Japan

[21] Appl. No.: 856,266

[22] Filed: Dec. 1, 1977

[30] Foreign Application Priority Data

Dec. 13, 1976 [JP] Japan ..... 51-149581

[51] Int. Cl.[2] ..... G04C 3/00

[52] U.S. Cl. ..... 58/23 R; 58/23 D; 58/85.5

[58] Field of Search ..... 58/23 R, 23 D, 50 R, 58/85.5, 34, 23 AC

[56] References Cited

U.S. PATENT DOCUMENTS

| | | | |
|---|---|---|---|
| 3,538,703 | 11/1970 | Walton | 58/23 R |
| 3,664,118 | 5/1972 | Walton | 58/50 R |
| 3,733,803 | 5/1973 | Hiraga et al. | 58/85.5 X |
| 3,852,950 | 12/1974 | Yoda et al. | 58/85.5 X |
| 4,043,109 | 8/1977 | Numabe | 58/23 AC X |

*Primary Examiner*—Ulysses Weldon

*Attorney, Agent, or Firm*—Sherman & Shalloway

[57] ABSTRACT

An electronic timepiece which is provided with a control circuit receiving as an input a time correction signal from a frequency divider circuit and delivering an output for driving an electro-mechanical converter so as to correct times of the timepiece. The control circuit is operated by an exteriorly operable switch means to select that signal by which the frequency divider circuit is reset when the timepiece is stopped and by which normal movement of hands and forward and backward rotation corrections of times are effected.

9 Claims, 18 Drawing Figures

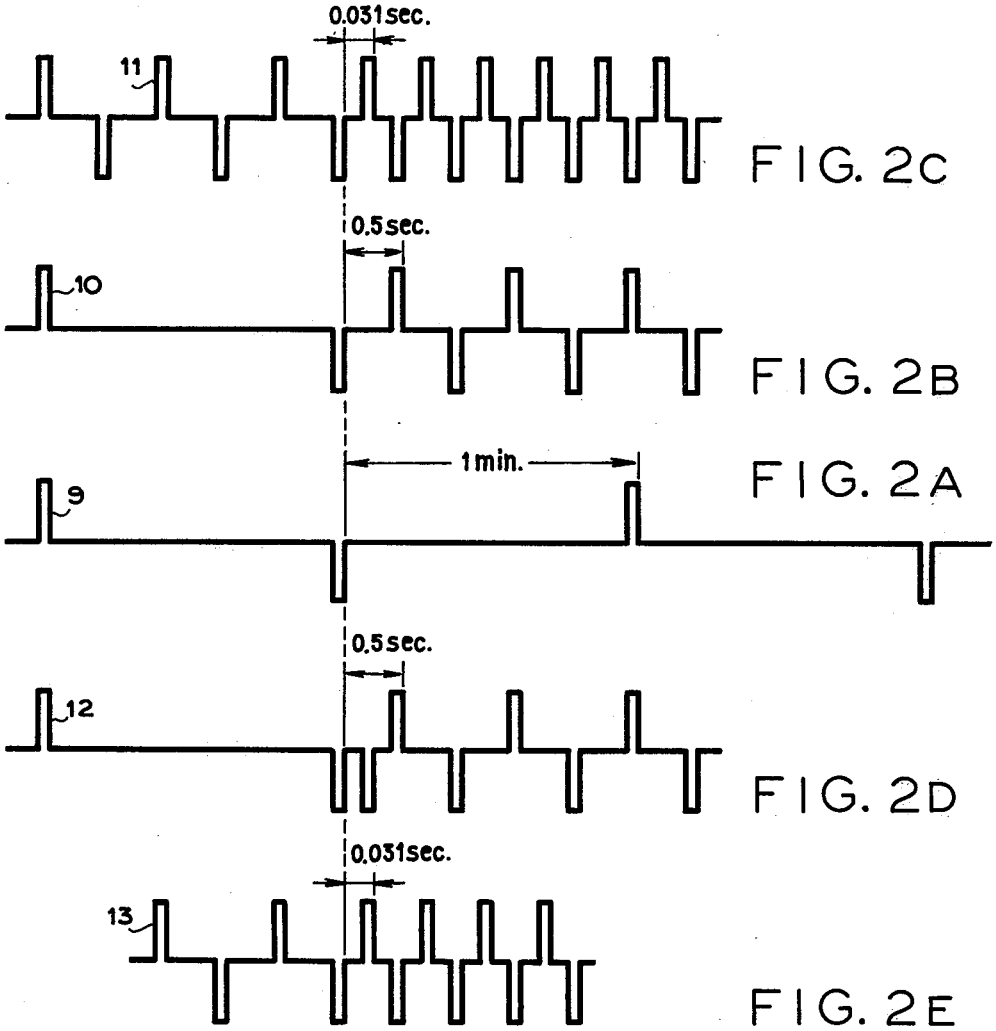
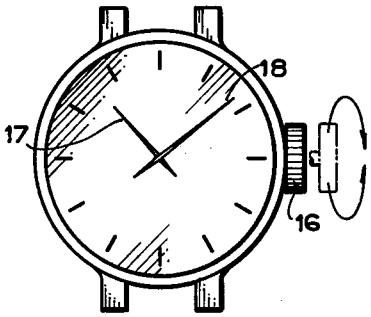
FIG. 3
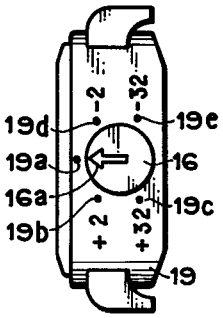
FIG. 4

ELECTRONIC TIMEPIECE

BACKGROUND OF THE INVENTION

1. Field of the Invention

This invention relates to electronic timepieces and more particularly to an electronic timepiece which is provided with a control circuit receiving as an input a time correction signal from a frequency divided circuit and delivering an output for driving an electro-mechanical converter so as to correct times of the timepiece.

2. Description of the Prior Art

In a conventional timepiece provided with hands for displaying times, it has been the common practice to rotate a winding crown of an exteriorly operable member and cause the amount of rotation thereof to be mechanically transmitted so as to set times of the timepiece. Such conventional electronic timepiece has the drawbacks that if much amount of correction must be effected, the rotation of winding crown results in the fatigue of one's fingers, that if use is made of a dial provided with graduations whose number is small, it is required to set those times with one's eyes which are not defined by the graduations, thereby rendering the time set inaccurate, that the time setting mechanism is complex in construction and requires a wide space, that the winding crown is required to be arranged in a limited plane and height and hence the arrangement cannot be changed for one kind of timepiece, and that provision must be made of a brake mechanism for preventing that extra gear train which is irrelevant to the time setting operation from being rotated.

In order to obviate the drawback which has been encountered with a conventional hand setting mechanism which makes use of a clutch wheel and setting wheel, an electrically hand setting mechanism for driving an electro-mechanical converter by means of a correction signal has also been proposed. Such conventional electrically hand setting mechanism can omit a hand setting back mechanism, slip coupling for a cannon pinion, brake for preventing rotation of a gear train, etc., and hence is very reliable in operation and can easily be manufactured. But, such conventional electrically hand setting mechanism makes use of push buttons and switches and hence has the drawback that its operation is very troublesome for persons accustomed to the conventional winding crown.

SUMMARY OF THE INVENTION

A principal object of the invention, therefore, is to provide an electronic timepiece which can eliminate the above described drawbacks which have been encountered with the prior art techniques.

Another object of the invention is to provide an electronic timepiece which can electrically effect a time setting operation by supplying a correction signal to an electro-mechanical converter without relying on the manual rotation.

A further object of the invention is to provide an electronic timepiece which is provided with an electrical time setting mechanism operable in the same manner as a winding crown.

BRIEF DESCRIPTION OF THE DRAWING

FIGS. 2A to 2E are graphs illustrating various kinds of pulses to be supplied to a driving circuit shown in FIG. 1;

FIG. 3 is a front elevational view of an electronic timepiece provided with circuit elements shown in FIG. 1;

FIG. 4 is its side elevational view;

DETAILED DESCRIPTION OF THE PREFERRED EMBODIMENT

Figure 1:
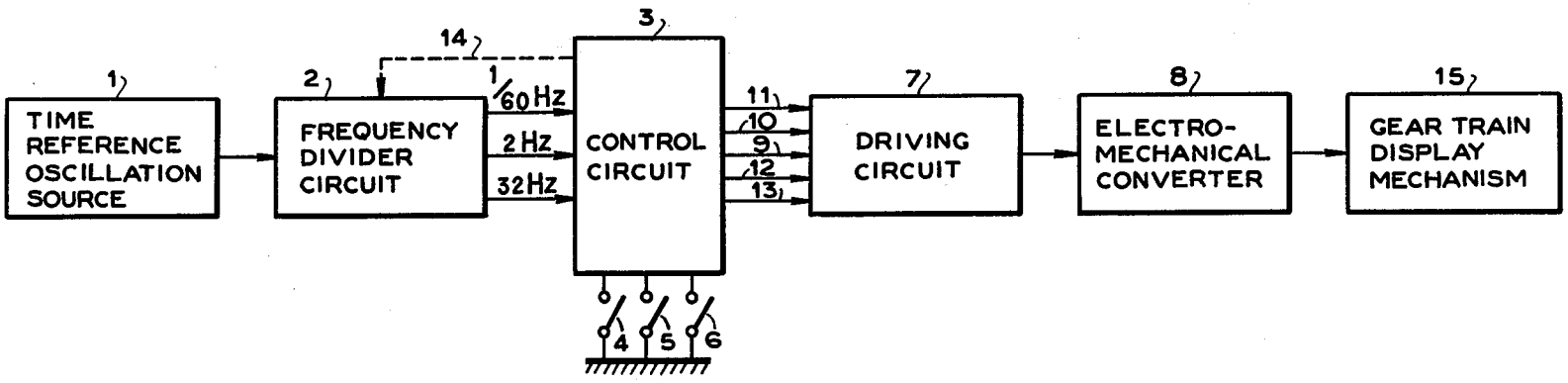
FIG. 1 is a block diagram of a first embodiment of an electronic timepiece according to the invention.

In FIG. 1 is shown a block diagram of a first embodiment of an electronic timepiece according to the invention provided with two hands including a minute hand adapted to be moved by one step to every one minute. A signal from a time reference oscillation source 1 such as a quartz oscillator is supplied to a frequency divider circuit 2 which functions to divide the frequency of signal and prepare a 1/60 Hz normally driving output signal and 2 Hz and 32 Hz time setting output signals. If necessary, use may be made of a counter circuit and memory circuit. The normally driving output signal and time setting output signals are supplied to a control circuit 3 which functions to select pulse signals to be delivered to a driving circuit 7 and control the direction of these pulse signals by operating a group of switches composed of a switch 4, switch 5 and switch 6. In FIG. 1, reference numeral 9 designates a normally driving pulse which is alternately generated with a frequency of 1/60 Hz as shown in FIG. 2A. Dotted lines 14 show a reset signal supplied from the control circuit 3 when the timepiece is stopped and for resetting the frequency divider circuit 2 at its suitable frequency divider stage. If the timepiece is started again, the minute hand moves after the lapse of one minute. Reference numeral 10 designates a 2 Hz clockwise direction correction pulse whose wave form is shown in FIG. 2B. If the normally driving pulse shown in FIG. 2A is changed over to the 2 Hz clockwise direction correction pulse shown in FIG. 2B, the 2 Hz clockwise direction correction pulse is started from a pulse whose direction is opposite to that of the last pulse thereof as shown in FIG. 2B. Reference numeral 11 designates a 32 Hz clockwise direction fast correction pulse whose wave form is shown in FIG. 2C. If the 2 Hz correction pulse shown in FIG. 2B is changed over to the 32 Hz fast correction pulse shown in FIG. 2C, the 32 Hz fast correction pulse is started from a pulse whose direction is opposite to that of the last pulse thereof as shown in FIG. 2C. Reference numeral 12 designates a 2 Hz counter clockwise direction correction pulse whose wave form is shown in FIG. 2D. If the normally driving pulse shown in FIG. 2A is changed over to the 2 Hz counter clockwise direction correction pulse, the 2 Hz counter clockwise direction correction pulse is started from a pulse whose direction is the same as that of the last pulse thereof as shown in FIG. 2D. Reference numeral 13 designates a 32 Hz counter clockwise direction fast correction pulse whose wave form is shown in FIG. 2E. If the 2 Hz counter clockwise direction correction pulse shown in FIG. 2D is changed over to the 32 Hz counter clockwise direction fast correction pulse, the 32 Hz counter clockwise direction fast correction pulse is started from a pulse whose direction is opposite to that of the last pulse thereof as shown in FIG. 2E. In the case of changing over the time correction to the normal driving, the change-over from FIG. 2C to FIG. 2B and the change-over from FIG. 2B to FIG. 2A as well as the change-over from FIG. 2E to FIG. 2D are effected without changing the direction of rotation of the minute hand and with the pulse after the change-over started in direction which is opposite to that of the pulse immediately before the change-over. The change-over from FIG. 2D to FIG. 2A is effected with the direction of rotation of the minute hand changed from the counter clockwise direction to the clockwise direction and with the pulse after the change-over started in a direction which is the same as that immediately before the change-over. A combination of the switches 4, 5 and 6 makes it possible to select one driving pulse among the driving pulses 9, 10, 11, 12 and 13 and supply the one driving pulse thus selected from the control circuit 3 to a driving circuit 7 which functions to drive an electro-mechanical converter 8.

The electro-mechanical converter 8 is rotated in one direction as long as pulses having opposite directions enter alternately thereinto and adapted to change the direction of rotation thereof when two pulses having the same direction enter thereinto. The electro-mechanical converter 8 functions to drive a gear train-display mechanism 15.

In FIGS. 3 and 4 is shown an electronic timepiece according to the invention which comprises the circuit elements shown in FIG. 1. When a winding crown 16 is at its normal position, an hour hand 17 and a minute hand 18 effect the usual time display. The minute hand 18 is driven by the normally driving pulse 9 and moved by one step every 1/60 Hz.

If the winding crown 16 is pulled out, the timepiece is brought into its reset condition under which no driving pulses are generated. If the winding crown 16 is pulled out by one step and then an index **16*a* shown by an arrow of the winding crown 16 is rotated from a reset point 19*a* in a counter clockwise direction to a point 19*b* designated by +2 on the case 19, the 2 Hz clockwise direction correction pulse 10 is supplied from the control circuit 3 to the driving circuit 7 to forwardly move the minute hand 18 by 2 steps to every 1 second. If the index 16*a* is further rotated in the counter clockwise direction to a point 19*c* designated by +32 on the case 19, the 32 Hz clockwise direction fast correction pulse 11 is supplied from the control circuit 3 to the driving circuit 7 to fast move the minute hand 18 by 32 steps to every 1 second. If the index 16*a* of the winding crown 16 is rotated in the clockwise direction to a point 19*d* designated by −2 on the case 19, the 2 Hz counter clockwise direction correct pulse 12 is supplied from the control circuit 3 to the driving circuit 7 to rotate the minute hand 18 in the counter clockwise direction by 2 steps to every 1 second. If the index 16*a* of the winding crown 16 is rotated in the counterclockwise direction to a point 19*e* designated by −32 on the case 19, the 32 Hz counter clockwise direction fast correction pulse 13 is supplied from the control circuit 3 to the driving circuit 7 to fast rotate the minute hand 18** in the counter clockwise direction by 32 steps to every 1 second.

If the minute hand 18 and the hour hand 17 interlocked therewith have been set to the time, the index **16*a* is returned to the reset point 19*a* and then the winding crown 16** is pushed into its normal position.

Even when the minute hand 18 is corrected in the counterclockwise direction, if the winding crown 16 is returned to the reset point **19*a*** and then pushed to its normal position, it is possible to effect the clockwise rotation.

The switches 4, 5 and 6 may be combined so as to exhibit abilities shown in the following Table.

| Switch (4) | Switch (5) | Switch (6) | Output Hz | |
|---|---|---|---|---|
| OFF | OFF | OFF | 1/60 | Normal Movement of Hands |
| ON | OFF | OFF | 0 | Reset |
| ON | ON | OFF | +2 | + Correction |
| OFF | ON | OFF | +32 | + Fast Correction |
| ON | OFF | ON | −2 | − Correction |
| OFF | OFF | ON | −32 | − Fast Correction |

As shown in the above Table, it is possible to select either one of six kinds of outputs by a combination of the switches 4, 5 and 6.

Figure 5:
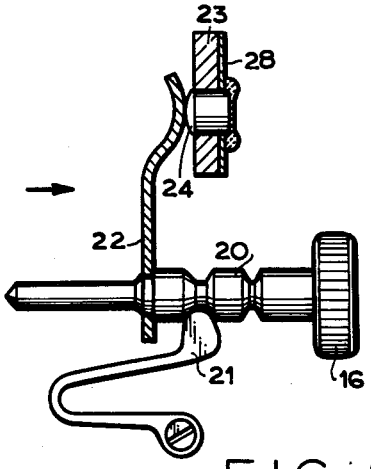
FIG. 5 is a side elevational view of a switch construction of the electronic timepiece shown in FIG. 1, partly shown in section.

In FIGS. 5 to 8 is shown a switch portion construction. In FIG. 5 is shown a condition under which the winding crown 16 is pulled out by one step. In this condition, the position of a winding stem 20 made integral with the winding crown 16 is determined by a lever 21 so as to make a free end of an electrically conductive sector-shaped spring 22 secured at its one end to the winding stem 20 in contact with a contact 24 provided a circuit substrate 23 and connected to a wiring 28. If the winding crown 16 is pushed into its normal position, the sector-shaped spring 22 is separated from the contact 24. The switch portion shown in FIGS. 5 to 8 is viewed in a direction shown by an arrow in FIG. 5. The contact 24 corresponds to the switch 4. Contacts 25 and 26 corresponding to the switches 5 and 6, respectively, are also provided on the circuit substrate 23 and connected to the wiring 28.

Figure 6:
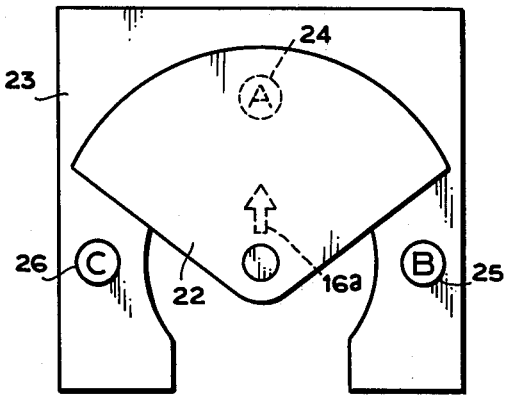
FIG. 6 is its front elevational view.

In FIG. 6 is shown the reset condition under which the winding crown 16 is pulled out by one step and the sector-shaped spring 22 makes contact with only the contact 24 corresponding to the switch 4.

Figure 7:
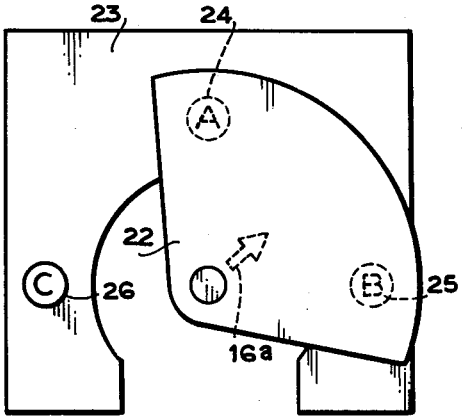
FIG. 7 is a view similar to FIG. 6, but showing another operating condition of the switch.

In FIG. 7 is shown the +2 correction condition under which the index **16*a* of the winding crown 16 is set to the point 19*b* designated by +2 on the case 19 and the sector-shaped spring 22 makes contact with both the contacts 24 and 25 corresponding to the switches 4 and 5**, respectively.

Figure 8:
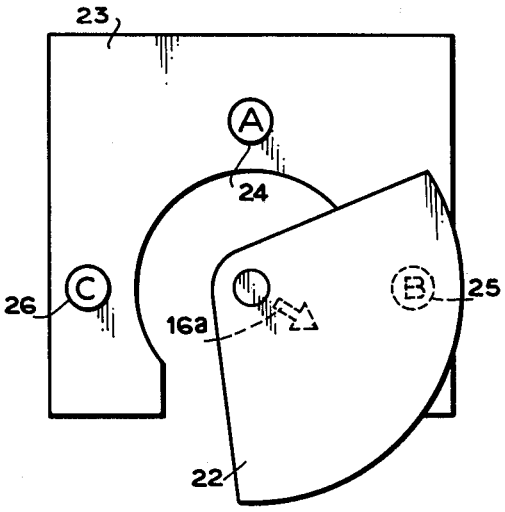
FIG. 8 is a view similar to FIG. 6, but showing a further operating condition of the switch.

In FIG. 8 is shown the +32 fast correction condition under which the index **16*a* of the winding crown 16 is set to the point 19*c* designated by +32 on the case 19 and the sector-shaped spring 22 makes contact with only the contact 25 corresponding to the switch 5. Similarly, the index 16***a* of the winding crown 16 may be set to the point 19*d* designated by −2 on the case 19 so as to make the sector-shaped spring 22 contact with the contacts 24 and 26 corresponding to the switches 4 and 6, respectively, thereby effecting the −2 correction and the index 16*a* of the winding crown 16 may be set to the position 19*e* designated by −32 on the case 19 so as to make the sector-shaped spring 22 contact with only the contact 26 corresponding to the switch 6, thereby effecting the −32 fast correction.

As described above, the winding crown 16 may be operated to change over the group of switches and select the pulse to be supplied from the control circuit 3 to the driving circuit 7. The pulse thus selected causes the driving circuit 7 to move through the electro-mechanical converter 8, the gear train-display mechanism 15, thereby effecting the time setting operation.

Figure 9:
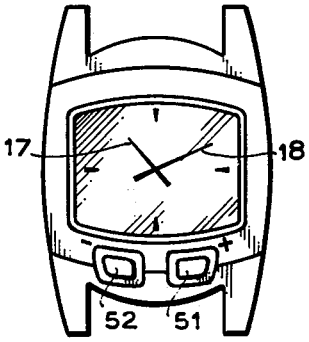
FIG. 9 is a front elevational view of a second embodiment of an electronic timepiece according to the invention.

In FIG. 9 is shown a second embodiment of an electronic timepiece according to the invention. In the present embodiment, use is made of two button switches 51 and 52 instead of using the winding crown 16.

In the present embodiment, the construction of the timepiece is the same as that of the first embodiment and various kinds of the button switches 51 and 52 my easily be constructed, so that how to operate these button switches will now be described. Each of the button switches 51 and 52 may be pushed by two steps and released to its reset condition. The minute hand 18 will start to move after the lapse of 1 minute.

If both the switches 51 and 52 are made OFF, the timepiece normally moves by one step to every one minute.

If the switch 51 only is pushed by one step, the 2 Hz clockwise direction correction of the minute hand 18 is effected. If the switch 51 is pushed by two steps, the 32 Hz clockwise direction fast correction of the minute hand 18 is effected. If the switch 51 is returned to its one step position, 2 Hz clockwise direction correction of the minute hand 18 is effected. If the finger is separated from the switch 51, the minute hand 18 is moved at its normal movement after the lapse of 60 seconds.

If the switch 52 only is pushed by one step, the 2 Hz counter clockwise direction correction of the minute hand 18 is effected. If the switch 52 is pushed by two steps, the 32 Hz counter clockwise direction fast correction of the minute hand 18 is effected. If the switch 52 is returned to its one step position, the 2 Hz counter clockwise correction of the minute hand 18 is effected. If the finger is separated from the switch 52, the minute hand 18 is rotated in the clockwise direction after the lapse of 60 seconds.

If both the switches 51 and 52 are simultaneously pushed, the frequency divider circuit 2 is reset to stop the operation of the timepiece. If the finger is separated from both the switches 51 and 52, the minute hand 18 is started to move after the lapse of 60 seconds. Provision may be made of a locking mechanism for the purpose of preventing erroneous operation of the button switches.

In the above described embodiments, to the hour and minute hands may be added a second hand. Rotating speed of the hands and the number of steps for changing over the rotating speed of the hands may be changed. The correction speed may continuously be changed by pushing the switches. In addition, the construction of members surrounding the switch portion may be altered. In the present embodiment, the time setting operation is electrically effected without manually rotating the winding crown. That is, the pulse signal to be supplied to the driving circuit 7 is selected by the operation of the switches. It is preferable to make the electro-mechanical converter 8 reversible.

In FIGS. 10 to 14 is shown a third embodiment of an electronic timepiece according to theinvention. In FIGS. 10 to 14, the same reference numerals designate the same or corresponding parts.

Figure 10:
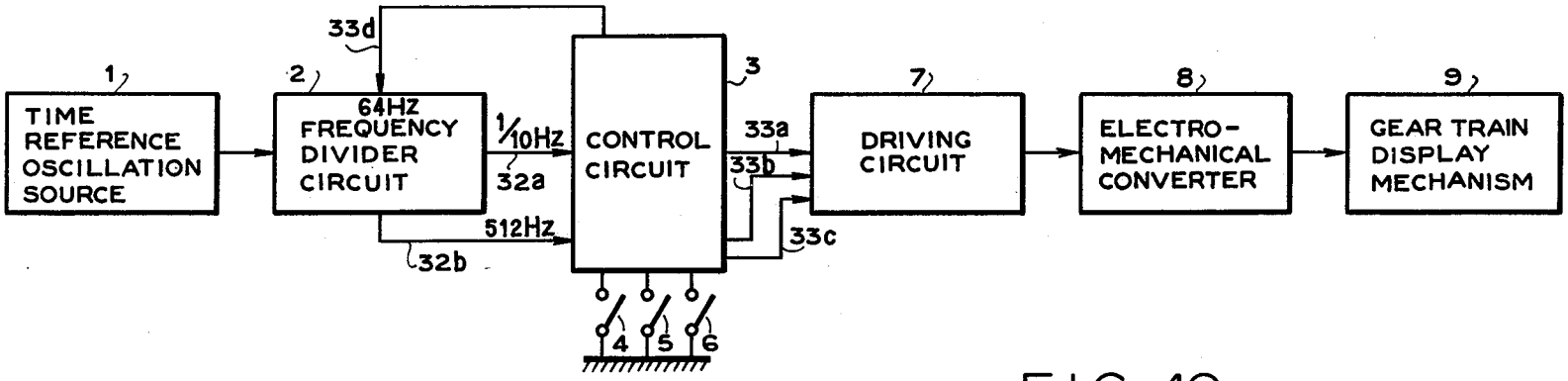
FIG. 10 is a block diagram of a third embodiment of an electronic timepiece according to the invention.

In FIG. 10 is shown a block diagram of a third embodiment of an electronic timepiece according to the invention provided with two hands including a minute hand adapted to be moved by one step to every 10 seconds. A signal is supplied from a time reference oscillation source 1 such as a quartz oscillator to a frequency divider circuit 2 which functions to divide the frequency of the signal received to prepare a 1/10 Hz normally driving signal 32*a* and a 512 Hz time correction signal 32*b* whose frequency is higher than that of the frequency divider stage which is reset when the timepiece is stopped. In this case, use may be made of a counter circuit and memory circuit, if necessary. The normally driving signal 32*a* and the time correction signal 32*b* are controlled in a control circuit 3 by operating a group of switches 4, 5 and 6 so as to determine the kind, number and direction of signals to be supplied to a driving circuit 7. Reference numeral 33*a* designates a 1/10 Hz normally driving output signal and 33*d* a reset signal adapted to stop the timepiece by operating a switch 4. The reset signal functions to reset the frequency divider circuit 2 at its 64 Hz frequency divider stage. If the timepiece becomes started again, the minute hand is moved after the lapse of 10 seconds. Reference numeral 33*b* designates a forward rotation time correction signal whose number corresponds to the number of ON operations of a switch 5. Reference numeral 33*c* designates a reverse rotation time correction signal whose number corresponds to the number of ON operations of a switch 6.

The signals 33*a*, 33*b* and 33*c* supplied from the control circuit 3 to a driving circuit 7 are selected by operating a combination of the switches 4, 5 and 6 and one of these signals thus selected is supplied to the driving circuit 7 which functions to drive an electro-mechanical converter 8. The electro-mechanical converter 8 functions to effect stop, time movement to every 10 seconds, forward direction correction rotation and backward direction correction rotation in response to the kind and number of the signal received and drive a gear train-display mechanism 9.

Figure 12:
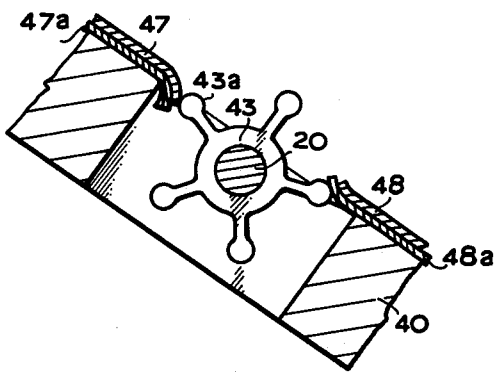
FIG. 12 is a cross-sectional view of main parts shown in FIG. 11 in an enlarged scale.
Figure 11:
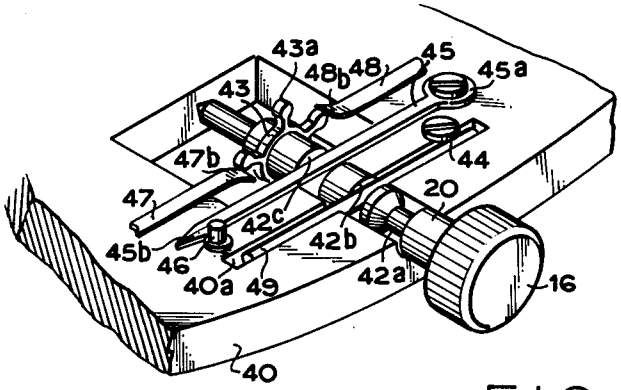
FIG. 11 is a perspective view of members arranged around a switch of the electronic timepiece shown in FIG. 10.

In FIGS. 11 and 12 are shown a time setting operation member composed of a winding crown 16 and the construction of members surrounding the switch. If the winding crown 16 is located at its normal position, a minute hand (not shown) is rotated by the 1/10 Hz normally driving output signal 33*a* and the hour hand (not shown) and minute hand function to effect the usual time display.

In FIG. 11 is shown the construction of the parts surrounding the switch when the winding crown 16 is pulled out by one step. In FIG. 12 is shown in section the main parts shown in FIG. 11 in an enlarged scale. A winding stem 20 made integral with the winding crown 16 is provided a groove 42*b* with which is engaged a position determining spring 49 enclosed in an indentation 40*a* provided in a base plate 40 and having one end secured to the base plate 40 by means of a screw 44. The winding stem 20 is provided also with a groove 42*c* with which is engaged a reset lever spring 45 rotatably supported at its one end 45*a* and having a free end 45*b* which is made contact with a reset switch terminal pin 46 insulated from the base plate 40. The reset lever spring 45 and pin 46 correspond to the switch 4 shown in FIG. 10. To the winding stem 20 is secured a switch cam 43. If the winding crown 16 is rotated in counter clockwise direction, teeth 43*a* of the switch cam 43 make contact with a forward rotation correction terminal spring 47 secured through an insulating layer 47*a* to the base plate 40. The teeth 43*a* and spring 47 correspond to the switch 5 shown in FIG. 10. If the winding crown 16 is rotated in clockwise direction, the teeth 43*a* of the switch cam 43 make contact with a backward rotation correction terminal spring 48 secured through an insulating layer 48*a* to the base plate 40. The teeth 43*a* and spring 48 correspond to the switch 6 shown in FIG. 10. The free ends 47*b* and 48*b* of the forward and backward rotation terminal springs 47 and 48 are so tapered that, when the winding crown 16 is pulled out and the teeth 43*a* of the switch cam 43 are urged against these free ends, these free ends allow to slidably pass the teeth of the switch cam therealong.

If the winding crown 16 is pushed, the position determing spring 49 becomes engaged with a groove 42*a*, and as a result, the switch cam 43 is separated from the forward and backward rotation correction terminal springs 47, 48 and the reset lever spring 45 is also separated from the reset switch terminal pin 46.

If the winding crown 16 is pushed and the timepiece is normally moved, all of the reset switch terminal pin 46, forward rotation correction terminal spring 47 and backward rotation correction terminal spring 48 become nonconductive. The 1/10 Hz normally driving signal 32*a* is supplied from the frequency divider circuit 2 through the control circuit 3 to the driving circuit 7 so as to operate the driving circuit 7.

If the winding crown 16 is pulled out, in the first place, the reset lever spring 45 engaged with the winding stem 20 makes contact with the reset switch terminal pin 46 and then the switch cam 43 is located at a position opposed to the forward rotation and backward rotation terminal springs 47, 48. If the reset switch 4 becomes ON, the control circuit 3 functions to supply the reset signal 33*d* to the 64 Hz frequency divider stage of the frequency divider circuit 2 to stop the supply of the 1/10 Hz normally driving signal 32*a* and hence causes the timepiece to stop the movement of its hands.

If the winding crown 16 is rotated in the counterclockwise direction, the teeth 43*a* of the switch cam 43 make contact with the forward rotation correction terminal spring 47 in succession. If one of the teeth 43*a* makes contact with the forward rotation correction terminal spring 47, one of the 256 Hz signals supplied from the frequency divider circuit 2 and ready in the control circuit 3 is supplied to the driving circuit 7 which causes the electro-mechanical converter 8 to operate. As a result, the minute hand 18 (FIG. 3) is moved by steps whose number is the same as the number of contacts between the teeth 43*a* of the switch cam 43 and the forward rotation correction terminal spring 47. In this case, the teeth 43*a* of the switch cam 43 make contact with the insulating layer 48*a* at the side of the backward rotation correction terminal spring 48 so that the switch 6 is held at its OFF condition.

If the rotation of the winding crown 16 is stopped, the reset already established causes the minute hand to stop. Similarly, in the case of pulling out the winding crown 16 and then rotating it in the clockwise direction, if the teeth 43*a* of the switch cam 43 make contact with the backward rotation correction terminal spring 48, the backward rotation correction signal 33*c* prepared in the control circuit 3 is supplied to the driving circuit 7 which then functions to operate the electro-mechanical converter 8.

Figure 13:
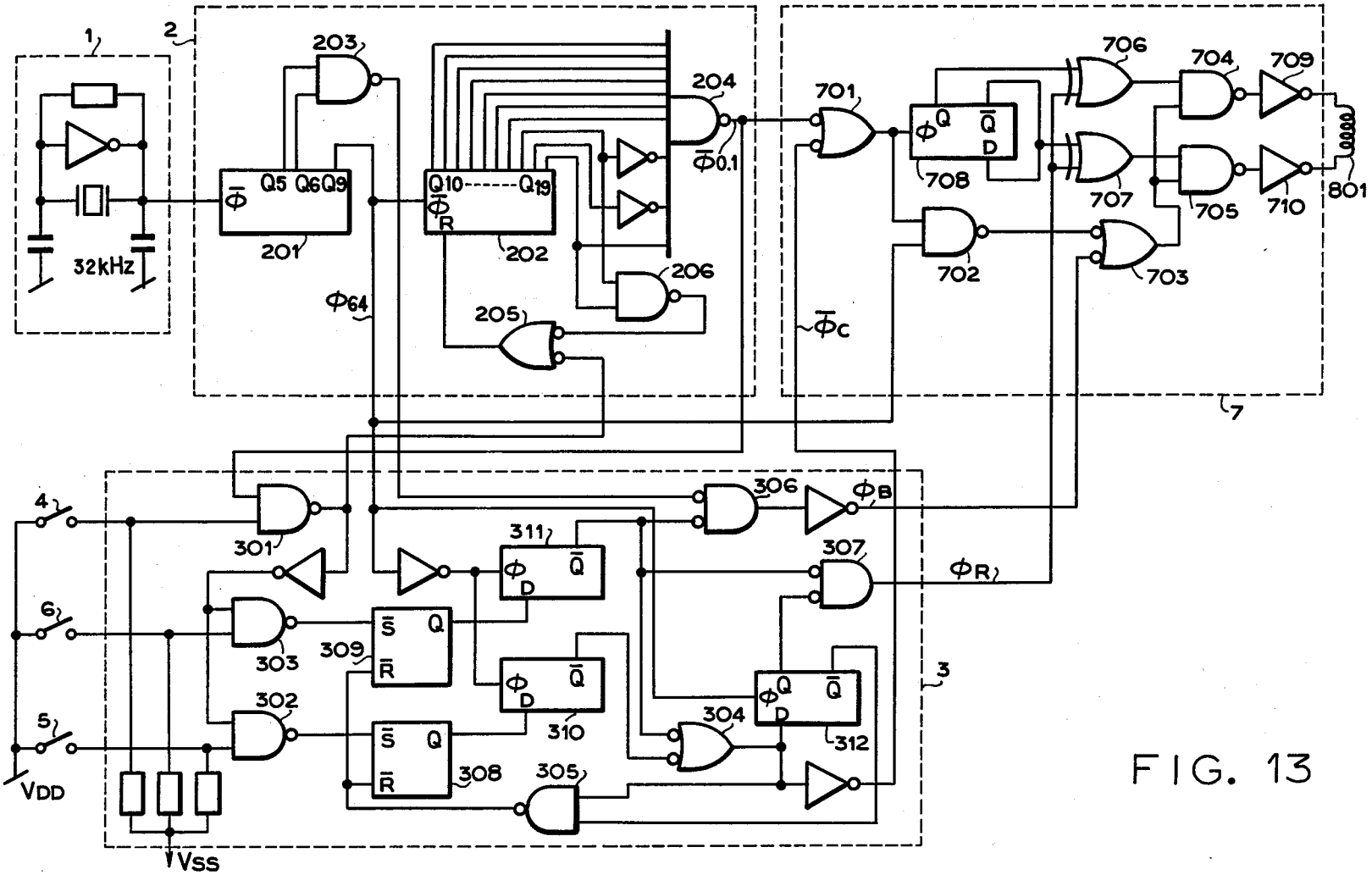
FIG. 13 is a detailed circuit diagram of FIG. 10.
Figure 14:
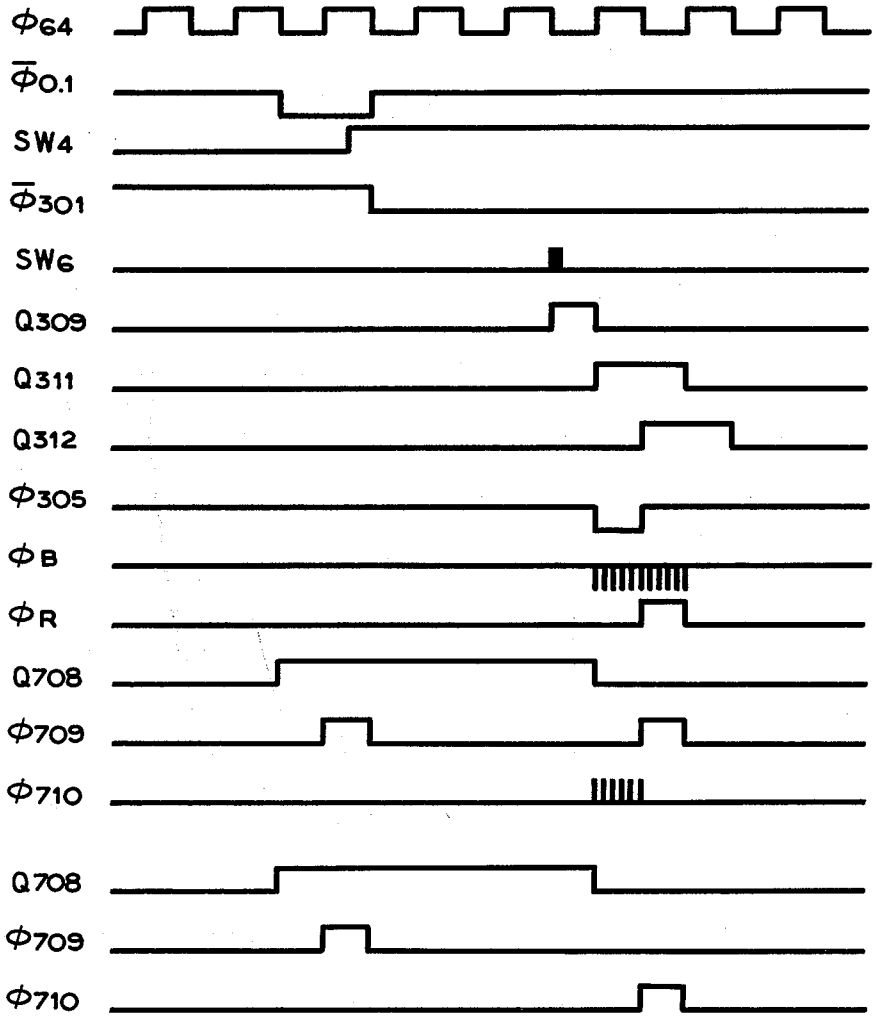
FIG. 14 shows waveforms of FIG. 13.

There will be described more detailed operation of a timepiece shown in FIG. 10 with reference to FIGS. 13 and 14.

Signals from the time reference signal oscillation source 1 comprising a crystal oscillator of 32.768 KHz are divided by the frequency divider circuit 2 into signals of 0.1 Hz required to drive the timepiece. The frequency divider circuit 2 comprises a frequency divider 201 of 9-stage binary counter, a frequency divider 202 of 10-stage counter 202, gates 203, 204, 205 and 206, etc. The output of 64 Hz from the output of the frequency divider 201 triggers the frequency divider 202 and at the same time functions as a clock pulse $\phi 64$ shaping the pulse width for driving a pulse motor and controlling time correction. The gate 203 shapes biasing pulses of 25% duty and 512 Hz by the outputs $Q_5$, $Q_6$ from the frequency divider 201 through the NAND gate 203. The NAND gate 204 and two inverters respectively connected between the frequency divider 202 and the NAND gate 204 provide a 0.1 Hz output and deliver a negative time signal output $\phi 0.1$ of 1/64 second in pulse width when the frequency divider is at "1001111111" in binary value. The gate 205 resets the frequency divider 202 by the output from the decimal feedback gate 206 upon reset operation. The driving circuit 7 drives the pulse motor and comprises gates 701, 702, 703, 704, 705, Exclusive-OR gate 706, 707, data-type flip-flops 708, and drivers 709, 710. The driving circuit 7 triggers the data-type flip-flop 708 generating alternating signals at timing of the trailing of the signal $\phi 0.1$ or time correction signal $\overline{\phi}c$ through the gate 701. Simultaneously the gate 702 shapes the pulse width for driving the pulse motor by the output from gate 701 and the output $\phi 64$ from the NAND gate. The driving pulses pass through the gates 704, 705 alternately in accordance with the state of signals Q, $\overline{Q}$ of the flip-flop 708. The driving pulses are supplied through the gate 703, which delivers the driving pulses with combining a biasing pulse $\phi B$ for reversing the pulse motor. The Exclusive-OR gate 706 inverts the alternating output phase of the driving pulse by the reverse pulse $\phi R$ upon the reverse time correction. The drivers 709, 710 amplify 0.1 Hz normal driving and forward-reverse time correction signals to energize a pulse motor driving coil 801. The control circuit 3 controls normal timepiece operation and forward-reverse time correction and controls the frequency divider circuit 2 and driving circuit 7 in accordance with the state of externally operating reset switch 4, forward correction switch 5 and reverse correction switch 6. The control circuit comprises gates 301 through 307, R-S flip-flop 308, 309 and D-type flip-flop 310, 311, 312. The reset switch 4 is closed so that the frequency divider 202 is reset. The gate 301 functions as a reset operation prohibiting gate during normal driving of the timepiece by the signal $\phi 0.1$. Gate 203 functions as forward-reverse correction prohibiting gate except at the time of resetting.

Under the resetting state, the reverse correction switch 6 is closed instantly so that R-S slip-flop 309 of reset and thereby the set state being held. At timing of the trailing of the signal $\phi 64$, D-type flip-flop 311 becomes Q311=1 so as to reset R-S flip-flops 308, 309 through the gates 304, 305 until the flip-flop 312 becomes Q312=1 at the timing of the next leading edge of the signal $\phi$64. The output from the gate 304 delivers the time correction pulse $\overline{\phi}$c through an inverter. The gate 306 and an inverter connected to the output of the gate 306 supply the reverse biasing pulse $\phi$B to a gate 703 during Q311=1. During Q311=1 and Q312=0, i.e. transmission of the driving pulses, the gate 307 inverted passing signals through the gates 706, 707 so that the alternating output phase of the driving pulse may be inverted.

When the forward correction switch is closed, the flip-flop 308, 310, 312 operate in turn so as to operate in the same manner upon the reverse operation. However, the flip-flip 311 is not inverted so that there are not delivered inverted pulses of the reverse biasing pulse $\phi$B and the driving pulse since the gates 306, 307 are inhibited.

The invention is not limited to the above described embodiments and various modifications may be made in details. For example, the forward and backward rotation correction terminal springs may be constructed and arranged such that the teeth of the switch cam are urged against these terminal springs so as to make electrically conductive therebetween. Alternatively, the forward and backward rotation correction terminal springs may be divided to increase the number of contacts with the teeth of the switch cam, thereby increasing the number of ON conditions of the correction switches 5 and 6. As to the hand setting speed, at least two correction signals to every one of the ON condition of the correction switch may be supplied from the control circuit so as to make the correction speed high. The control circuit may be provided therein with a detection circuit for detecting a space between successive ON conditions of the correction switch and for supplying two or three signals to every one ON condition of the correction switch to the driving circuit as the rotating speed of the winding crown becomes high. Alternatively, if the rotation of the winding crown becomes high, the pulse width or driving timing of the signal for driving the electro-mechanical converter may be changed such that one such signal is supplied with two steps. In addition, the hand setting operation may be effected by rotating the winding crown in one direction only.

As stated hereinbefore, the invention is capable of transmitting signals through wirings provided on the case with the aid of exteriorly operable members such as a winding crown, push buttons and the like. The use of the measures described has a number of advantages. In the first place, a time setting mechanism which is complex in construction is not required and a large space necessary for such time setting mechanism can be made small. Secondly, the exteriorly operable members may freely be arranged so as to easily provide various designs. Third, in the case of time setting operation, a brake for preventing rotation of extra gear train is not required such that a dial graduated at 12 hour, 3 hour, 6 hour and 9 hour only, for example, may be used so as to precisely set times by counting the number from the above mentioned graduations. Fourth, the time setting operation may be effected by directly and electrically driving an electro-mechanical converter without having recourse to rotary transmission of a back gear train. Finally, the time setting operation may be effected in the same manner as the conventional manner, so that complex and delicate mechanisms and parts which cause damage failure are not required and hence provision may easily be made of a timepiece which is thin in thickness and small in size.

What is claimed is:

1. An electronic timepiece comprising a. a high frequency time reference signal source for generating a time reference signal;

b. a frequency divider circuit for dividing the frequency of said time reference signal and delivering a time unit signal and time correction signals;

c. a control circuit connected to said frequency divider circuit such that said control circuit receives as an input a plurality of time correction signals from said frequency divider circuit;

d. an exteriorly operable switch means connected to said control circuit and causing said control circuit to select said time correction signals;

e. a driving circuit receiving as an input the output signal from said control circuit;

f. a reversibly rotable electro-mechanical converter for effecting electro-mechanical conversion of a driving signal from said driving circuit;

g. a gear train-time display mechanism receiving an output from said electro-mechanical converter so as to set times of the timepiece; and h. said frequency divider circuit is reset by a reset signal supplied from said control circuit.

2. The electronic timepiece according to claim 1, wherein said electro-mechanical converter is driven by that output from said control circuit which corresponds to the number of rotations of said exteriorly operable switch means.

3. The electronic timepiece according to claim 1, wherein the rotating speed of said electro-mechanical converter is changed in response to the rotating of said exteriorly operable switch means.

4. The electronic timepiece according to claim 1, wherein said exteriorly operable switch means is composed of three contacts connected to said control circuits and a rotatable member made integral with a winding crown and selectively brought into contact with said contacts.

5. The electronic timepiece according to claim 1, wherein said exteriorly operable switch means is composed of externally mounted push button switches.

6. The electronic timepiece of claim 1 wherein said frequency divider circuit divides said high frequency time reference signal source into a driving output signal of 1/60 Hz, and time setting output signals of 2 Hz and 32 Hz.

7. The electronic timepiece of claim 1 wherein said frequency divider circuit divides said high frequency time reference signal source into a driving output signal of 0.1 Hz and a time correction signal having a frequency higher than the frequency of said driving output signal.

8. The electronic timepiece of claim 7 wherein said time correction signal has a frequency of 512 Hz.

9. The electronic timepiece of claim 8 wherein said high frequency time reference signal is comprised of a crystal oscillator having a frequency of 32.768 KHz.

* * * * *